US006368162B1

(12) United States Patent
Reetz et al.

(10) Patent No.: US 6,368,162 B1
(45) Date of Patent: Apr. 9, 2002

(54) TEMPERATURE RESISTIVE ELECTRICAL DISTRIBUTION BLOCK

(76) Inventors: Kerry L. Reetz, S2510 S. 140$^{th}$ Ave., Fall Creek, WI (US) 54742-4931; Vern Krupa, 5910 County Rd. K, Chippewa Falls, WI (US) 54729

( * ) Notice: Subject to any disclaimer, the term of this patent is extended or adjusted under 35 U.S.C. 154(b) by 0 days.

(21) Appl. No.: 09/631,195

(22) Filed: Aug. 3, 2000

Related U.S. Application Data

(60) Provisional application No. 60/146,911, filed on Aug. 3, 1999.

(51) Int. Cl.$^{7}$ ..... H01R 11/09
(52) U.S. Cl. ..... 439/723
(58) Field of Search ..... 439/709, 721, 439/723, 724, 797, 798

(56) References Cited

U.S. PATENT DOCUMENTS

| | | | | | |
|---|---|---|---|---|---|
| 1,836,951 | A | | 2/1931 | Blakeslee | 200/507 |
| 1,929,925 | A | | 10/1933 | Kuhn | 439/690 |
| 2,126,891 | A | | 8/1938 | Kelsay | 220/3.8 |
| 2,610,996 | A | | 9/1952 | Rickabaugh | 439/713 |
| 2,762,026 | A | | 9/1956 | Knohl | 439/748 |
| 3,263,129 | A | | 7/1966 | Glassman | 361/730 |
| 3,323,021 | A | | 5/1967 | Sever | 361/808 |
| 3,350,677 | A | * | 10/1967 | Daum | 439/724 |
| 3,354,421 | A | * | 11/1967 | Rodgers, III | 439/721 |
| 4,382,651 | A | * | 5/1983 | Klosin et al. | 439/798 |
| 4,700,271 | A | * | 10/1987 | Iio et al. | 439/723 |
| 4,872,092 | A | | 10/1989 | Lush et al. | 361/823 |
| 4,891,023 | A | * | 1/1990 | Lopata | 439/637 |
| 4,924,213 | A | | 5/1990 | Decho et al. | 340/653 |
| 5,052,950 | A | | 10/1991 | Wilson | 439/709 |
| 5,088,940 | A | * | 2/1992 | Saito | 439/621 |
| 5,199,905 | A | * | 4/1993 | Fillinger | 439/723 |
| 5,361,189 | A | | 11/1994 | Miyashita | 361/807 |
| 5,588,880 | A | | 12/1996 | Wood | 439/709 |
| 5,741,073 | A | | 4/1998 | Ribeiro et al. | 374/182 |
| 5,966,295 | A | | 10/1999 | Park | 361/823 |
| 6,162,081 | A | * | 12/2000 | Commerei et al. | 439/287 |

* cited by examiner

*Primary Examiner*—Brian Sircus
*Assistant Examiner*—Hae Moon Hyeon
(74) *Attorney, Agent, or Firm*—Kinney & Lange, P.A.

(57) ABSTRACT

An electrical distribution block has an electrically insulative and temperature resistant housing and a conductive rod having multiple electrical connection locations spaced along its length. The conductive rod is inserted into the housing, and the housing allows access to the electrical connection locations on the conductive rod. An electrical connection may be established by inserting a wire through the housing and into the electrical connection location. A fastener for maintaining the electrical connection is accessible through the housing to press the wire against the conductive rod.

21 Claims, 3 Drawing Sheets

TEMPERATURE RESISTIVE ELECTRICAL DISTRIBUTION BLOCK

CROSS-REFERENCE TO RELATED APPLICATION(S)

The present application claims priority from Provisional Application Ser. No. 60/146,911, filed Aug. 3, 1999, entitled ELECTRICAL DISTRIBUTION BLOCK.

BACKGROUND OF THE INVENTION

The present application relates to electrical distribution blocks, and, more particularly, to electrical power distribution blocks designed specifically for high temperature applications. Such thermal-resistant distribution blocks allow for maintaining an electrical connection under extreme thermal conditions.

In many instances, electrical distribution blocks are used with electrical elements having short electrical leads. The short wires forces the electrical distribution block to be mounted near to the electrical element, often exposing the electrical distribution block to the high temperature environment. In a situation where a sensor is used in a furnace, such exposure can be severe.

In addition, even if the materials are individually temperature resistant, fluctuations in temperature may effect the integrity of the electrical contacts over time. In particular, connections may weaken due to variations in thermal expansion rates between the various materials.

Further, high temperatures can increase electrical resistance within conductive materials, precipitating undesired power loss. Thus, the connection must be formed and maintained using temperature resistant materials, which have conductive properties that are similarly unaffected by high temperatures.

Finally, once the electrical distribution block is mounted in the high temperature environment, repair time and connection set up time should be minimized. Thus, it is desirable to have an electrical distribution block that allows for connections from more than one direction, so as to facilitate repair, upgrades, and maintenance over time.

BRIEF SUMMARY OF THE INVENTION

A temperature resistant, electrical distribution block has an electrically insulative housing and a conductive rod. The conductive rod defines multiple electrical connection locations spaced along its length. The conductive rod is inserted into the housing, and the housing allows access to the electrical connection locations through the housing. An electrical connection may be established by inserting a wire through the housing and into the electrical connection location. Fasteners are accessible through the housing for pressing each wire against the conductive rod and for maintaining the electrical connection between the wires and the conductive rod.

While the above-identified drawing figures set forth a preferred embodiment, other embodiments of the present invention are also contemplated, some of which are noted in the discussion. In all cases, this disclosure presents the illustrated embodiments of the present invention by way of representation and not limitation. Numerous other minor modifications and embodiments can be devised by those skilled in the art which fall within the scope and spirit of the principles of this invention.

DETAILED DESCRIPTION

Figure 3:
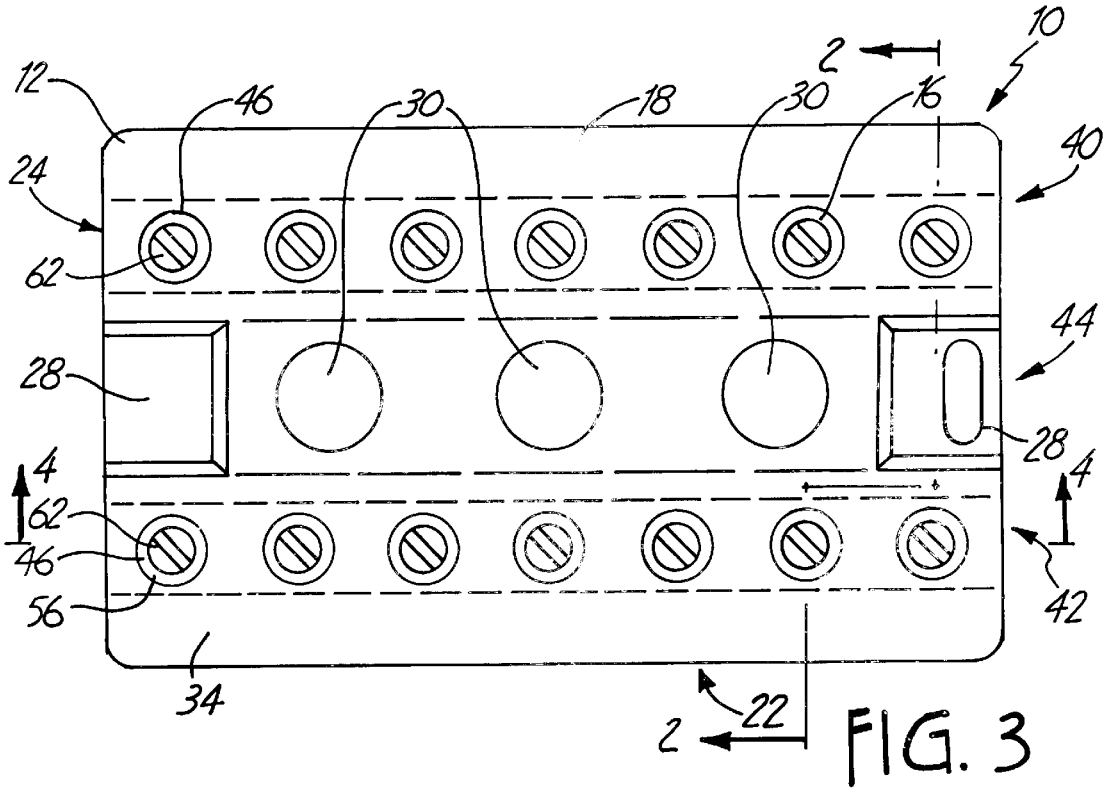
FIG. 3 is a top plan view of the electrical distribution block of FIG. 1.
Figure 4:
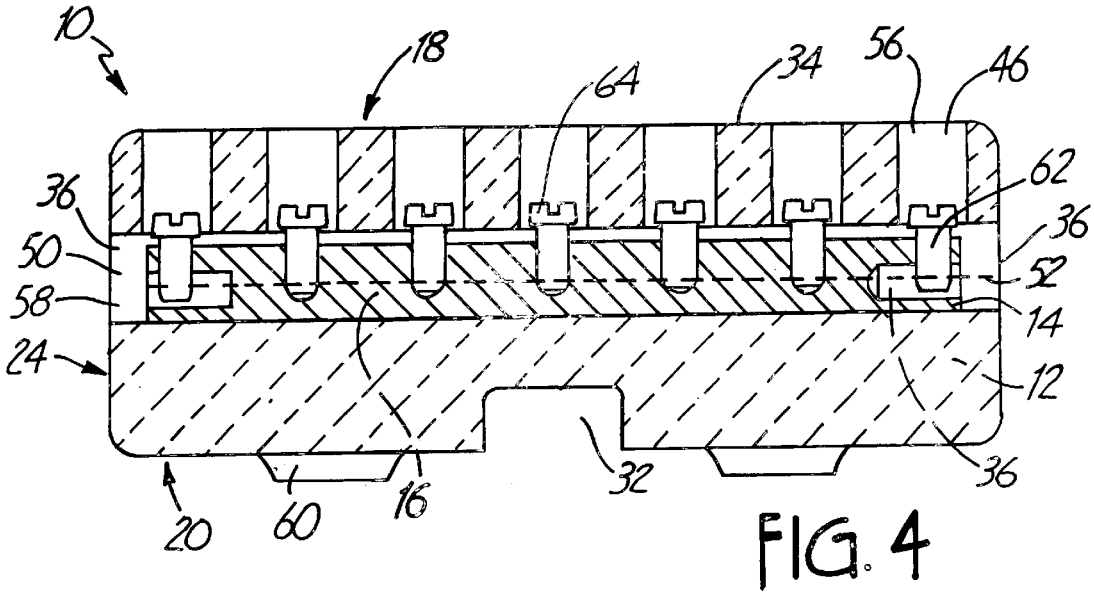
FIG. 4 is a cross-sectional side view of the electrical distribution block of FIG. 1.
Figure 5:
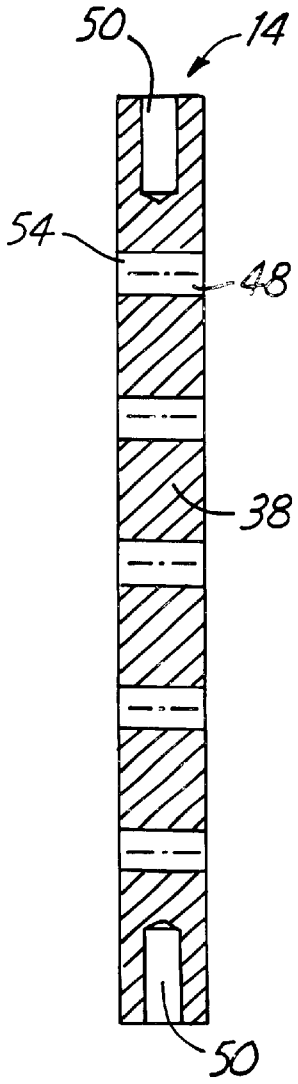
FIG. 5 is a cross-sectional top view of the conductive rod housed in the electrical distribution block of FIG. 1.
Figure 7:
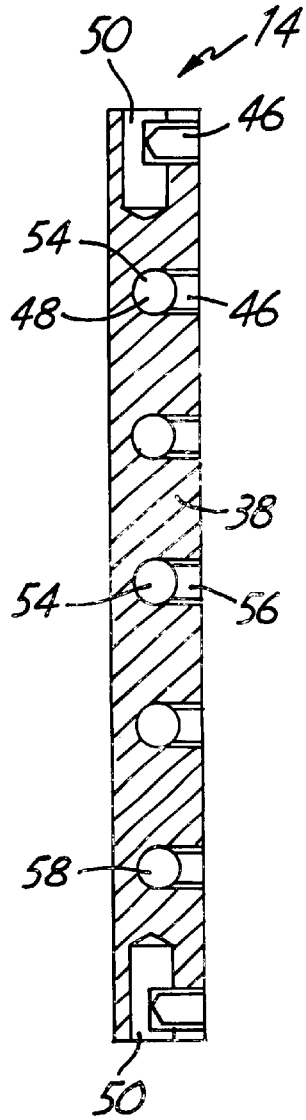
FIG. 7 is a cross-sectional side view of the conductive rod.
Figure 6:
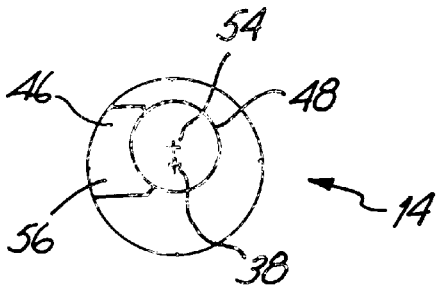
FIG. 6 is a cross-sectional end view of the conductive rod.

FIGS. 1–7 illustrate an electrical distribution block 10 incorporating the present invention, including a housing 12, a conductive rod 14 and fasteners 16. FIGS. 1–4 illustrate the electrical distribution block 10 in the assembled position, and FIGS. 5–7 illustrate the conductive rod 14 removed from the electrical distribution block 10.

The housing 12, conductive rod 14, and fasteners 16 maybe formed in any of a variety of ways known in the art, only one of which is described here for explanatory purposes. The electrical distribution block 10 is described for use in a cycled heat environment, but the present invention is equally applicable in stable temperature environments.

The electrical distributor block 10 is designed for use in a cycled heat environment, wherein the temperature fluctuates over a wide range quite rapidly. The housing 12 is formed of ceramic. In the preferred embodiment, the housing 12 is formed of ceramic, which rated as temperature resistant to 1000 degrees Celsius. The most preferred material for the housing 12 is porcelain of the type KER111 according to DIN 40680. The housing 12 is substantially rectangular, generally having a top 18, a bottom 20, two sides 22, and two ends 24. In the preferred embodiment, the housing 12 is approximately 63.5 millimeters long, 38 millimeters wide, and 25.4 millimeters high.

Figure 1:
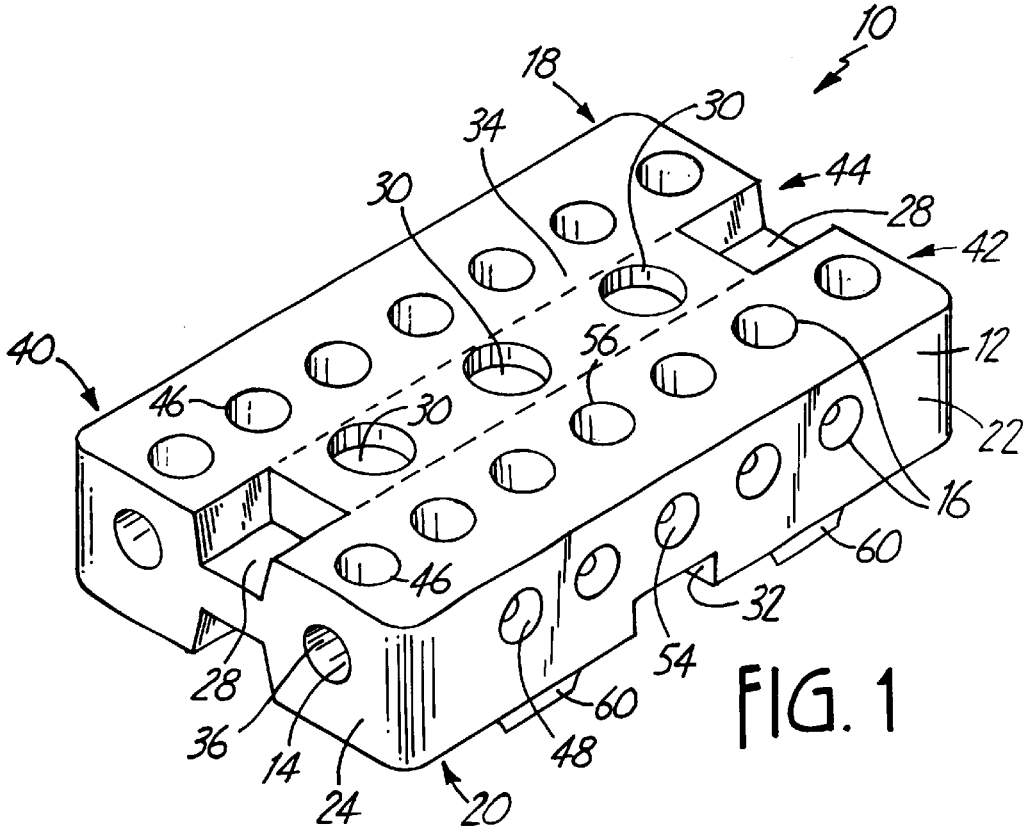
FIG. 1 is a perspective view of the electrical distribution block.

As shown in FIG. 1, the top 18, the sides 22 and the ends 24 of the housing 12 have openings 46,48,36. Though the opposing side 22 and end 24 may not be seen in this view, the preferred embodiment is symmetrical both in length and width, and the description of the side 22 and end 24 which follows is equally applicable to both sides 22 and ends 24, respectively.

In the preferred embodiment, the housing 12 has four trapezoidal cutouts 28 on the top 18 and bottom 20. The cutouts 28 serve several purposes. First, the cutouts 28 provide a gripping surface during assembly. Second, the cutouts 28 increase the amount of surface area exposed to the environment, and reduce the volume of the housing 12. The cutouts 28 are sized to maintain a relatively uniform distribution of ceramic across the housing 12.

In a cycled heat environment, the cutouts 28 provide relief points for tension and compression stresses, and assist in relatively uniform heating and cooling of the housing 12. In addition, by assisting in relatively uniform distribution of ceramic material and providing relief points for compression and tension stresses, the cutouts 28 prevent cracking of the housing 12 over time and contribute to the overall durability of the housing 12. In the preferred embodiment as shown, the cutouts 28 extend vertically into the housing 12 approximately 8 millimeters, longitudinally into the housing 12 approximately 8.6 millimeters, and horizontally approximately 9 millimeters at the cutout bottom 32 and 11 millimeters at the cutout top 34.

In addition, the top 18 of the housing 12 defines circular cutouts 30. The circular cutouts 30, like the trapezoidal cutouts 28, provide relief for tension and compression forces during cycled heating and cooling. In addition, the circular cutouts 30 may also be drilled to provide through holes for fixedly attaching the housing 12 to a structure (not shown). The circular cutouts 30 are aligned longitudinally along the top 18 the housing 12 and are spaced evenly to maintain a relatively uniform volume of ceramic throughout the length the housing 12. In the preferred embodiment, there are three circular cutouts 30, spaced approximately 15.85 millimeters center to center and from the edges 24 to the center of the first circular cutout 30. In the preferred embodiment, each circular cutout 30 is centered horizontally and has a diameter of approximately 7.5 millimeters.

Figure 2:
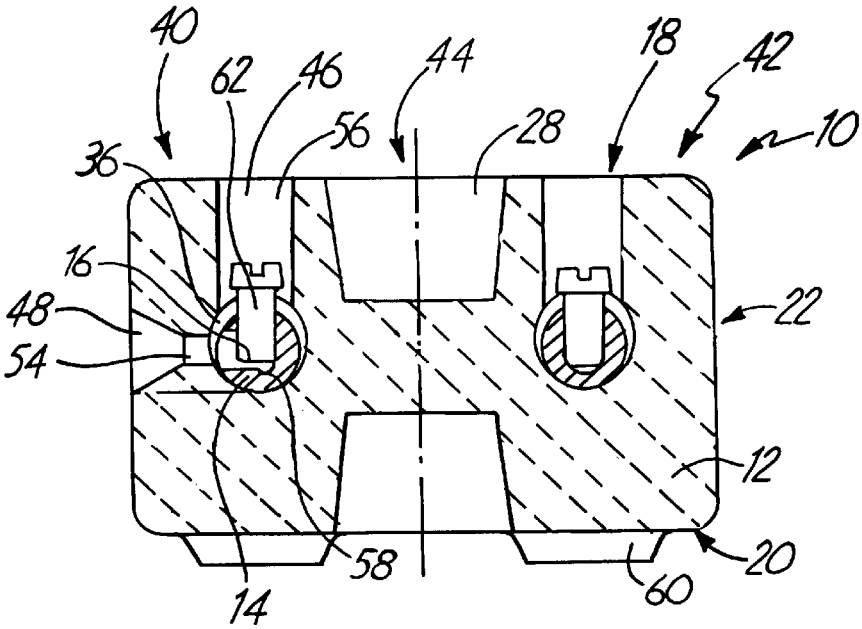
FIG. 2 is a cross-sectional end view of the electrical distribution block of FIG. 1.

FIG. 2 illustrates the end 24 of the housing 12. On each end 24 of the housing, two longitudinal bore holes 36 extend the entire length of the housing 12. The longitudinal bore holes 36 are sized to fit a metal conductive rod 14 (shown in FIGS. 5–7), two of which maybe inserted into the longitudinal bore holes 36. In the preferred embodiment, the longitudinal bore holes 36 are approximately 6.5 millimeters in diameter, and the conductive rod 14 is slightly smaller to allow for different rates of thermal expansion and contraction. In addition, in the preferred embodiment, the longitudinal bore holes 36 are positioned slightly closer to the top 18 than to the bottom 20 (approximately 10.65 millimeters from the top 18 to the longitudinal axis 38 of the longitudinal bore hole 36). Positioning the longitudinal bore holes 36 closer to the top 18 allows the ceramic housing 12 to insulate the conductive rod 14 from the support structure (not shown). In cycled heat environments, the support structure maybe formed of any number of different materials. Since the thermal properties of the support structure cannot be determined in advance, the longitudinal bore holes 36 are offset away from the bottom 20 and the support structure (not shown) in order to insulate the conductive rod 12.

As shown in FIG. 2, the cutouts 28 cause the end 24 of the housing 12 to be substantially H-shaped. As previously described, the ends 24 have two longitudinal bore holes 36, one on each side 22, and two cutouts 28 on the center of the top 18 and bottom 20. The two longitudinal bore holes 36 are sized to receive the conductive rod 14. By providing an insertable rod 14, the electrical distribution block 10 permits the conductive rod 14 to be replaced after installation of the housing 12. The two longitudinal bore holes 36 are positioned slightly above the mid point vertically on the end 24 of the housing 12.

As shown in FIG. 3, the top 18 can be divided into three sections: a left distributor section 40 (shown in FIG. 3 at top), a right distributor section 42 (shown in FIG. 3 at bottom), and a center section 44. The center section 44 contains the circular cutouts 30 as previously discussed. The left and right distributor sections 40,42 are substantially the same, except that they are positioned on opposite sides of the housing 12. The description of the right distributor section 42 which follows can be applied equally to the left distributor section 40 as they are substantially the same.

The right distributor section 42 defines several vertical holes 46 across the top of the housing 12. The vertical holes 46 are aligned longitudinally along the length of the housing 12, and centered over the longitudinal bore hole 36 corresponding to the right distributor section 42. The vertical holes 46 extend from the top 18 into the longitudinal hole 32.

In the preferred embodiment, the vertical holes 46 are approximately 5.6 millimeters in diameter, approximately 1.0 millimeters smaller than the longitudinal bore hole 36. The vertical holes 46 are spaced evenly along the top 18. In the preferred embodiment, the vertical holes 46 are spaced 9 millimeters center to center, and approximately 4.8 millimeters from either end 24 to the center of the first vertical hole 46. The vertical holes 46 are spaced to allow for substantially uniform distribution of ceramic throughout the housing 12. In addition, the vertical holes 46 provide relief from tension and compression stresses. When a screw is inserted into the vertical hole 46, the housing 12 thermally insulates the screw from the surrounding environment, preventing the screw or wire from cooling or heating too quickly relative to the surrounding housing 12. Finally, the housing 12 prevents human contact with the screw, reducing the likelihood of accidental electrical shocks.

While the vertical holes 46 could extend completely through the housing to allow for mounting of a screw through the hole 46 from either the top 18 or the bottom 20 of the housing 12, in the preferred embodiment the housing 12 is designed to be mounted to an underlying support structure (not shown). Since the bottom 20 is designed to be mounted to a support structure, the bottom 20 does not have holes 46 sized to receive a screw because it would be difficult to access such holes after the housing 12 was mounted.

As shown in FIG. 1, the sides 22 of the ceramic housing 12 define horizontal holes 48 which extend into the housing 12. The horizontal holes 48 are aligned with the vertical holes 46 along the right distributor section 42 of the housing 12. The housing 12 defines two fewer horizontal holes 48 along the side 14 than vertical holes 46 across the top 18.

As shown in FIG. 4, the vertical hole 46 on either end 24 of the right distributor section 42 corresponds with an end hole 50 on the conduct rod 14. The end hole 50 is discussed further with regard to FIGS. 5–7. As can be seen, in the preferred embodiment, the end hole 50 is positioned slightly below the central axis 52 of the conductive rod 14, when viewed in cross-section from the side 22.

The conductive rod 14 can accept a wire through the end hole 50, allowing an additional electrical attachment on each end 24. The end hole 50 also permits one electrical distribution block 10 to be connected to an adjacent electrical distribution block (not shown), to allow the electrical distribution blocks to be connected in series.

The horizontal holes 48 extend into the housing 12 to meet the longitudinal bore hole 36. The horizontal holes 48 are aligned longitudinally along the side 14, and are positioned vertically so as to be centered over the longitudinal bore hole 36. The horizontal hole 48 has a slightly smaller diameter than the longitudinal bore hole 36. In the preferred embodiment, the horizontal holes 48 are approximately 5.6 millimeters in diameter. Like the vertical holes 46, the horizontal holes 48 serve a dual purpose of insulating the wire from the surrounding environment and from human contact. In addition, the horizontal holes 48 provide access to the longitudinal bore hole 36, allowing access to the conductive rod 16 when it is inserted into the longitudinal bore hole 36.

The vertical and horizontal holes 46,48,50 are aligned vertically in pairs, such that each vertical hole 46 has a corresponding horizontal hole 48 or end hole 50. The vertical and horizontal or end holes 46,48,50 are paired such that a wire may be inserted into one hole 46,48 and a screw may be tightened into the corresponding hole 50 to establish an electrical contact with the conductive rod 14. Alternatively, if desired, screws may be positioned horizontally through holes 48,50 and wires inserted vertically though holes 46. Thus, it does not matter whether the wire or the screw is inserted into the vertical hole 46, the other should be inserted into the corresponding horizontal or end hole 48,50. In the preferred embodiment, the vertical holes 46 and the horizontal and end holes 48,50 are position to allow access to the electrical attachments through the sides 22, the ends 24, and the top 18.

In an alternative embodiment, the housing 12 may define a access slots (not shown), formed by interconnecting the horizontal holes 48 and interconnecting the vertical holes 46. The access slots could allow access to the conductive rod 14. In addition, the conductive rod 14 similarly could define connection slots (not shown) allowing insertion of a wire and insertion of a screw to fix the wire into place.

The conductive rod 14 is insertable into the housing 12 through the end 24 of the housing 12. As shown in FIGS. 5–7, end holes 50 extend longitudinally into the conductive rod 14. Wire holes 54 also extend horizontally into the rod 14. Screw holes 56 also extend into the conductive rod 14 from other directions, such as vertically, each wire hole 54 paired with one screw hole 56 to allow the screw (shown in FIGS. 2–4) to tighten down onto a wire (not shown). In the present invention, the wire hole 54 and the screw hole 56 extend into the conductive rod 14 and connect at an angle less than 180 degrees. In the preferred embodiment, the wire holes 54 extend the fill width of the diameter of the conductive rod 14. The screw holes 56 extend slightly more than half-way through the conductive rod 14, intersecting the wire holes 54 at a 90 degree angle.

The 90 degree attachment angle allows the screw (shown in FIGS. 2–4) to tighten down against the wire, pressing the wire against the far side 58 of the wire hole 54. A connection at an angle greater than 90 degrees may result in gradual loosening of the electrical connection, particularly in the cycled heat environment.

The vertical holes 46 are aligned so as to be centered over the central axis 52 of the conductive rod 14, and over the screw holes 56 in the conductive rod 14. In the preferred embodiment, the vertical holes 46 are not threaded, but the screw holes 56 are, allowing the screw 62 to be inserted into the vertical hole 46 and tightened down into the screw hole 56.

The horizontal holes 48 are similarly aligned so as to be centered over the central axis 52 of the metal rod 14 and over the wire holes 54. However, in the preferred embodiment, neither the wire holes 54 nor the horizontal holes 48 are threaded. In an alternative embodiment, both the wire holes 54 and the screw holes 56 can be threaded, leaving the choice as to whether as to use the vertical holes 46 for the wires or the screws 62 for the time of installation.

While the housing 12 can be produced with holes 46,48 that are threaded, in the preferred embodiment, the holes 46,48 are not threaded. Instead, the holes 46,48 provide access to the conductive rod 14, and the holes 54,56 on the conductive rod 14 are threaded. Thus, the screw 62 can be inserted through the hole 46 in the housing 12 and tightened into the screw hole 56.

The distribution block 10 is designed to be used in high temperature, cycled heat environments, meaning the temperatures fluctuates. The cutouts 28,30,32 are positioned to maintain a nearly uniform material distribution across the housing 12. Because of the cycle heating and cooling, if the housing 12 had more material on one end or on the other or at various points along the housing 12, those areas might retain heat or not heat as quickly as other areas placing. These areas could become weak points in the housing 12, causing the housing 12 to crack and fracture. The cutouts both circular 30 and square 28,32, permit the housing 12 to heat and cool in uniform fashion to prevent cracking.

FIG. 3 shows a top view of the block 10. Both the sides 22 and the top 18 can have any number of holes 48,46 as the particular application requires; however, the number of holes 48 on the side 22 should be two less than the number of holes 46 across the top 18 to permit insertion of the wire into the end hole 50 of the inserted rod 14.

As shown in FIG. 4, the horizontal holes 48 are positioned slightly above the vertical midpoint of the side 22 of the housing 12. The cutout 32 along the bottom 20 of the housing 12 divides the housing 12 in two. In the embodiment shown, cutout 32 provides stress relief along the bottom 20 of the housing 12. In addition, in the preferred embodiment, the housing 12 has legs 60, which allow air to flow between the housing 12 and the mounting structure (not shown). This air gap allows for convection heating and cooling of the housing 12, largely independent of thermal conduction from the underlying mounting structure.

As the distribution block 10 is intended to be used in a cycled heat environment, it is imperative to maintain a relatively uniform thickness throughout the block 10. The combination of the cutouts 28,30,32 and the bore holes 46,48 cooperate to maintain a relatively uniform thickness throughout the housing 12. As the housing 12 is heated, the housing expands slightly and the cutouts 28,30,32 and bore holes 46,48 provide relief for the thermal expansion. Since the cutouts 28,30,32 and bore holes 46,48 assist in maintaining a relatively uniform thickness across the housing 12, the housing 12 also cools relatively uniformly.

In the preferred embodiment, the conductive rod 14 is approximately 5.5 millimeters in diameter, and 58 millimeters long, formed of NICLAFOR 1000-TD4 (CuNi9Sn6), which is rated as temperature resistant to 300 degrees Celsius. The screws or fasteners 62 are formed of steel with DACROMET, chromium based alloy plating, which is rated as temperature resistant to 350 degrees Celsius.

As FIG. 4 illustrates, the screws 62 can be tightened down into the conductive rod 14, where the head 64 of the screw 62 is surrounded completely by the ceramic housing 12. Since metal typically expands and contracts more rapidly than ceramic, a screw 62 can easily become loose over time in the cycled heat environment. However, the deep inset of the screw 62 in the present invention offsets the thermal differences between the ceramic housing 12 and the metal screw 62, maintaining a heated envelop for the screw 62 during the cycling process. In other words, as the ceramic housing 12 cools, the inset of the screw 62 maintains a heat or temperature proximately equal that of the surrounding housing 12, essentially keeping the screw 62 warm until the housing 12 cools, and preventing the screw 62 from thermally contracting before the housing 12 thermally contracts. In addition, the housing 12 insulates the screw 62 and the conductive rod 14 from human contact.

The offset alignment of the end holes 50 permit the fastening screw 62 to tighten down against the inserted wire. By offsetting the hole 50 away from the central axis 52 of the metal rod 14, the hole 50 is positioned closer to the ceramic housing 12 and away from the screw 62. The ceramic housing 12 maintains the temperature of the metal rod 14. This is particularly important at the ends 24 of the housing 12, where the wire or screw 62 can be inserted into the end hole 50 because the end hole 50 is not surrounded by the housing 12. Instead, the end hole 50 is exposed to the environment, allowing for more rapid changes in temperature, depending on the environmental conditions. The offset of the end hole 50 from the central axis 52 controls for the potential temperature changes by using the housing 12 as a insulator. In a preferred embodiment, the end hole 50 is offset away from the central axis 52 toward the underlying mounting structure approximately 0.5 millimeters. In a more preferred embodiment, the end hole 50 is offset away from the central axis 52 approximately a distance greater than 5 percent of the diameter of the conductive rod 14. In the most preferred embodiment, the end hole 50 is offset away from the central axis 52 a distance approximately equal to 9 percent of the diameter of the conductive rod 14.

In the preferred embodiment, the metal rod 14 is offset upward in the housing away from the underlying mounting structure. The legs 60 and offset of the longitudinal bore holes 36 help to insulate thermally the conductive rod 14 from the underlying mounting structure. As it is unknown at the time of production what type of structure the housing 12 will be mounted to, the electrical connections should be protected from overly rapid cycling of heating and cooling through thermal conduction from the underlying mounting structure. As previously indicated, the metal components are more affected by the cycled heating and cooling than the ceramic housing 12. The offset allows the housing 12 to provide an insulative or buffer layer between the underlying mounting surface and the metallic rod 14.

In the present invention, the distribution block 10, by virtue of the combination of materials used and structural design, is temperature resistant up to 300° Celsius. In addition, the inset of the screws 62 and the positioning of the cutouts 28,30,32 permit the use of the distributor block 10 in the cycled heat environment for an extended period of time without deterioration of the electrical connections or cracking of the housing 12.

The positioning of the screw holes 62 and the alignment of the holes 46,48,50 relative to each other permit the mounting of the housing 12 and subsequent attachment of the wires to the distribution block 10. As such a block 10 will likely be used within another structure, flexibility as to the mounting of the wires and direction of the screws 62 is desirable to permit easy installation of the distributor block 10.

While the present invention has been described with regard to cutouts 28,30,32, the circular cutouts 30 may serve an additional purpose, allowing for fixable mounting of the housing 12 to another structure. Holes (not shown) could be drilled or formed in the locations of the circular cutouts 30, passing entirely through the housing 12, to allow for the housing 12 to be mounted.

In an alternative embodiment, the openings on the housing 12 may be interconnected. In addition, the openings on the conductive rod 14 may be connected or continuous along the length of the rod 14.

Although the present invention has been described with reference to preferred embodiments, workers skilled in the art will recognize that changes may be made in form and detail without departing from the spirit and scope of the invention.

What is claimed is:

1. An electrical distribution block comprising:

a ceramic housing; and conductive rod having a plurality of electrical connection openings spaced longitudinally on the conductive rod;

wherein the ceramic housing defines a longitudinal cavity sized to receive the conductive rod; and wherein the ceramic housing allows access to the electrical connection openings on the conductive rod from at least two different directions for wires.

2. The electrical distribution block of claim 1, wherein each electrical connection location is a paired opening, each paired opening comprising;

a wire opening; and a fastener opening;

wherein the paired openings are visible through the ceramic housing when the conductive rod is inserted into the cavity;

wherein a wire is insertable through the ceramic housing into the wire opening to establish an electrical connection with the conductive rod, and further comprising:

a fastener inserted through the ceramic housing into the fastener opening for maintaining an electrical connection between the inserted wire and the conductive rod.

3. The electrical distribution block of claim 2, wherein the plurality of paired openings includes an end pair comprising;

an end opening for receiving the wire; and a second opening for receiving the fastener;

wherein the end opening extends longitudinally into the conductive rod, the end opening defines an axis aligned apart from a longitudinal axis of the conductive rod.

4. The electrical distribution block of claim 1, the housing having an upper surface and a lower surface with a depth therebetween;

wherein the upper surface defines a plurality of upper cutouts, the upper cutouts aligned centrally along a length of the housing, the upper cutouts extending less than the full depth of the housing, the upper cutouts providing a gripping surface and maintaining a consistent depth across the housing; and wherein the lower surface defines a plurality of lower cutouts, at least two of the plurality of lower cutouts positioned on opposing ends of the housing, and at least one other lower cutout extending less than the full depth of the housing.

5. The electrical distribution block of claim 1, wherein the housing further comprises:

legs providing a separation to allow air flow between the housing and a mounting surface.

6. The electrical distribution block of claim 1, wherein the housing is formed from porcelain.

7. The electrical distribution block of claim 1, wherein the conductive rod is formed primarily from Nickel alloy.

8. The electrical distribution block of claim 2, wherein the fastener is formed from steel with chromium based alloy plating.

9. The electrical distribution block of claim 1, wherein one of the at least two directions for wires comprises:

an end opening.

10. The electrical distribution block of claim 1, wherein the ceramic housing defines openings from a third direction for fastening means.

11. An electrical distribution block comprising:

a housing, the housing being electrically and thermally insulative, the housing defining a longitudinal cavity, the housing having a plurality of faces, the housing defining cutouts arranged so as to maintain a substantially uniform material distribution across the housing; and a conductive rod sized to fit within the cavity, the conductive rod having screw tightening openings and wire insertion openings wherein the housing provides access to the screw tightening openings and the wire insertion opening from at least two different directions.

12. The electrical distribution block of claim 11, wherein the housing is temperature resistant to at least 1000° Celsius.

13. The electrical distribution block of claim 11, wherein the conductive rod is temperature resistant to at least 300° Celsius.

14. The electrical distribution block of claim 11, wherein a wire is insertable through the housing into the wire insertion opening to establish an electrical connection with the conductive rod; and wherein a screw is inserted into through the housing into the screw tightening opening for maintaining the electrical connection between an inserted wire and the conductive rod.

15. The electrical distribution block of claim 14, wherein the screw is temperature resistant to at least 350° Celsius.

16. An electrical distribution block comprising:

a housing for use in a cycled heat environment, the housing being temperature resistant to 1000° Celsius, the housing having cutouts spaced along the surface of the housing so as to maintain a substantially uniform material distribution throughout the housing, the housing defining a cavity having a cavity diameter, the housing allowing access to the cavity; and a conductive rod having fastener openings and wire openings the conductive rod being temperature resistant to at least 300° Celsius, the conductive rod sized to fit within the cavity and having a diameter less than the cavity diameter.

17. The electrical distribution block of claim 16, wherein the conductive rod comprises:

fastener openings; and wire openings;

wherein the fastener openings and wire openings are spaced longitudinally on the conductive rod, the fastener openings and wire openings extending into the conductive rod and joining to form an angle less than 180°; and wherein a wire is insertable through the housing into one of the wire openings, a faster may be inserted through the housing into the fastener opening to maintain an electrical connection between an inserted wire and the conductive rod.

18. The electrical distribution block of claim 17, wherein the conductive rod has an end opening sized to receive a wire on an end of the conductive rod, the end opening extending longitudinally into the conductive rod, the end opening positioned away from a longitudinal axis of the conductive rod a distance of at least two percent of a diameter of the conductive rod.

19. The electrical distribution block of claim 17, wherein the wire openings and fastener openings are all interconnected.

20. The electrical distribution block of claim 16, wherein the housing is 63.5 millimeters long, 25.4 millimeters high, and 38 millimeters wide.

21. An electrical distribution block comprising:

a ceramic housing defining cutouts arranged so as to maintain a substantially uniform material distribution throughout the ceramic housing, the ceramic housing having legs sized to provide separation to allow air flow between the ceramic housing and a mounting surface; and a conductive rod having a plurality of electrical connection openings spaced longitudinally on the conductive rod;

wherein the ceramic housing defines a longitudinal cavity sized to receive the conductive rod; and wherein the ceramic housing access to the electrical connection openings on the conductive rod from at least two different directions.

* * * * *